US006102533A

United States Patent [19]

Nozawa et al.

[11] Patent Number: 6,102,533

[45] Date of Patent: Aug. 15, 2000

[54] INK CONTAINER, INK CONTAINER HOLDER FOR REMOVABLY HOLDING INK CONTAINER, AND INK CONTAINER CAP

[75] Inventors: Minoru Nozawa, Yokohama; Keiichiro Tsukuda, Kawasaki, both of Japan

[73] Assignee: Canon Kabushiki Kaisha, Tokyo, Japan

[21] Appl. No.: 08/919,348

[22] Filed: Aug. 28, 1997

[30] Foreign Application Priority Data

| | | | |
|---|---|---|---|
| Aug. 30, 1996 | [JP] | Japan | 8-229518 |
| Aug. 30, 1996 | [JP] | Japan | 8-230449 |
| Feb. 14, 1997 | [JP] | Japan | 9-029492 |
| Feb. 14, 1997 | [JP] | Japan | 9-030377 |
| Apr. 28, 1997 | [JP] | Japan | 9-111457 |

[51] Int. Cl.[7] ..... B41J 2/175

[52] U.S. Cl. ..... 347/86

[58] Field of Search ..... 347/85, 86, 87, 347/108, 24, 29, 31, 49

[56] References Cited

U.S. PATENT DOCUMENTS

| | | | |
|---|---|---|---|
| 5,523,780 | 6/1996 | Hirosawa et al. | 347/86 |
| 5,583,549 | 12/1996 | Ujita et al. | 347/86 |
| 5,589,862 | 12/1996 | Ujita et al. | 347/87 |
| 5,604,523 | 2/1997 | Tsukuda et al. | 347/86 |
| 5,619,237 | 4/1997 | Inoue et al. | 347/86 |
| 5,619,239 | 4/1997 | Kotaki et al. | 347/86 |

FOREIGN PATENT DOCUMENTS

| | | |
|---|---|---|
| 376719 | 7/1990 | European Pat. Off. . |
| 551752 | 7/1993 | European Pat. Off. . |
| 552030 | 7/1993 | European Pat. Off. . |
| 559206 | 9/1993 | European Pat. Off. . |
| 622234 | 11/1994 | European Pat. Off. . |
| 627323 | 12/1994 | European Pat. Off. . |
| 639462 | 2/1995 | European Pat. Off. . |
| 665108 | 8/1995 | European Pat. Off. . |
| 698497 | 2/1996 | European Pat. Off. . |
| 7-179004 | 7/1995 | Japan . |
| 8-58107 | 3/1996 | Japan . |
| 8-224883 | 9/1996 | Japan . |
| 8-276601 | 10/1996 | Japan . |

*Primary Examiner*—N. Le
*Assistant Examiner*—Michael Nghiem
*Attorney, Agent, or Firm*—Fitzpatrick, Cella, Harper & Scinto

[57] ABSTRACT

An ink container, containing different inks for recording, detachably mountable in an opening of an ink container holder, the ink container including a claw-like projection for engagement with a first hole provided in an inner surface of the opening adjacent one end thereof; a latch claw for engagement with a second hole provided in an inner surface of the opening adjacent the other end thereof, the latch claw being provided on a latch lever resiliently supported on the ink container; a projection corresponding to a guiding member provided on an inside of each of side walls of the container holder, which side walls connect the one end and the other end of the ink container holder, the projection being provided on each lateral side at a front portion in a mounting direction of the ink container; wherein the ink container is mounted in the ink container holder by rotating the ink container after being guided by the guiding members; a plurality of ink supply ports in a bottom surface, wherein at least one portion between two of the ink supply ports is provided with a groove parallel with a guiding direction of the guiding member.

10 Claims, 8 Drawing Sheets

INK CONTAINER, INK CONTAINER HOLDER FOR REMOVABLY HOLDING INK CONTAINER, AND INK CONTAINER CAP

FIELD OF THE INVENTION AND RELATED ART

The present invention relates to an ink container which holds ink supplied to an ink jet head employed in an ink jet type recording apparatus, an ink container holder which removably holds the ink container, and a cap which is fitted to the ink container. In particular, it relates to such an ink container that integrally comprises a plurality of independent ink chambers in order to separately hold inks of different color, and also an ink container holder which removably holds such an ink container.

Among various recording apparatuses which record images on recording medium such as paper, fabric, plastic sheet, OHP sheet, or the like, which hereinafter may be referred to as "recording paper" for simplicity, some have been proposed in the form of an apparatus in which a recording head is mountable. There are various recording systems available for a recording head mountable in such an apparatus; for example, there are a wire dot system, a thermal system, a thermal transfer system, and an ink jet system.

In particular, a recording apparatus employing a recording head based on an ink jet system has been widely used as outputting means for an information processing system. For example, it is used as a printer, that is, an information outputting peripheral device, for a copy machine, a facsimile, an electronic typewriter, a word processor, a work station, or the like. Also, it is used as a handy printer, that is, a portable printer, provided in a personal computer, a host computer, an optical disk player, a video apparatus, or the like. Further, it has been widely marketed.

The systems for ejecting ink from a recording head employed in an ink jet type recording apparatus such as the one described above can be classified according to the means they employ to generate ejection energy. As for a system employed to generate ejection energy, there have been known a system which employs an electromechanical transducer such as a piezo-electric element, a system which employs a device such as a laser which irradiates electromagnetic wave to generate heat to eject droplets of ink, a system which employs an electrothermal transducer element such as a heat generating resistor to generate liquid. The ink which is ejected from a recording head is supplied from an ink container, which generally comprises an ink absorbent member, a vessel which houses the ink absorbent member, and a cap which seals the vessel.

It has been known that some ink containers are rendered integral with a recording head, and others are rendered removably connectable to a recording head. In either case, the positioning of an ink container relative to a recording head is essential to print quality. In addition, the positioning of an ink container and a recording head relative to the carriage or the like of an ink jet recording apparatus is just as important as the positional relationship between an ink container and a recording head.

Whether a recording head and an ink container are separate or integral with each other, a mechanism for mounting, or positioning, them on the carriage of an ink jet recording apparatus must be relatively small, because an ink jet recording apparatus is relatively small and therefore, affords only a small space for the mechanism. As for such a mechanism small enough for an ink jet recording apparatus, a layer type mechanism has been known, in which a lever is used to move a recording head and an ink container, which are separate or integral, in various directions.

However, prior to the present invention, a mechanism such as the aforementioned one which moves an ink container and/or a head cartridge in various directions while mounting or dismounting them, complicated the structure of the carriage, and the complication made the structure larger, which led to increase in the overall size of the apparatus, making it difficult or impossible in some cases to produce a small printer. Besides, the complicated structure was liable to relatively complicate the operation for mounting or dismounting of an ink container and/or a recording head. Therefore, it is essential to the success of an ink jet apparatus that a mechanism (hereinafter, "mounting-dismounting mechanism), such as the one described above, for mounting or dismounting an ink container and/or a recording head is reduced in size while being simplified in structure and operation, being rendered reliable in operation, and being prevented from becoming inferior in terms of positioning accuracy.

In order to accomplish the above object, various inventions have been made pertaining to an ink container structure. For example, Japanese Laid-Open Patent Application Nos. 58107/1996, 224883/1996 and 276601/1996 disclose an invention pertaining to a structure for an ink container which has an opening for feeding out the ink contained therein. According to these inventions, the opening, that is, an ink delivery port of the ink container, is connected to the ink receiving means of an ink container holder, in the process in which the ink container is removably inserted in the ink container space of the ink container holder. Further, the ink container is provided with claw-shaped projections, which are located at the joint between the front wall, relative to the direction in which the ink container is inserted, and the bottom wall of the ink container, at lengthwise ends thereof, one for each end, and an elastic projection, which is attached to the bottom portion of the rear wall, extending diagonally upward, and engages with the locking hole provided in the rear wall of the ink container holder to properly set the ink container in the ink container holder.

In recent years, objectives in the field of an ink jet head has become multidirectional: a direction to reduce size as described above; a direction to increase ink container capacity to reduce operational cost; and a direction to increase the number of ink chambers in a single ink container to store a plurality of inks of different color and different color density (for example, high color density yellow ink, high color density magenta ink, high color density cyan ink, low color density yellow ink, low color density magenta ink, and low color density cyan ink) in order to deliver print quality equal to that of photography. In particular, in the case of the direction to increase ink capacity or ink chamber count, ink container weight and the number of points between the ink delivery ports of the ink container and the ink receiving pipes of the ink container holder, become far greater than those of an ink container which has been used in the past. Therefore, the inventors of the present invention, who are seriously concerned with current trend in ink container development, earnestly studied the above described large capacity ink container and the holder therefor in terms of expected problems, and came to recognize that the following points are essential in producing a desirable ink container and the ink container holder therefor.

(1) In crease in the amount of the ink held in an ink container increases the pressure applied to the adjacencies of the ink delivery port by the increased weight of the ink in the ink container. Therefore, the possibility of color ink mixture traceable to ink leakage from the ink delivery port of each ink chamber must be taken into consideration.

(2) It is desirable that an ink container smoothly latches and successful connection is reliably made between the plurality of the ink delivery ports on the ink container side and the ink receiving ports on the head side.

(3) The impact which occurs if an ink container were to be accidentally dropped could become relatively large, and therefore, a latching claw must be protected from such an impact.

(4) It must be assured that an ink container is capable of efficiently supplying ink even after it goes through various orientation changes during transportation, and also it is necessary to provide an ink container with a sealing means which is most suitable to prevent ink leakage during transportation of the ink container.

It is unnecessary that all the problems described above are solved by a single invention; an invention may solve only one of the above problems, although it is obvious that it is desirable that a plurality of the above problems are solved with a single invention.

Further, it is necessary to consider, in addition to the above object or independently therefrom, color ink mixture which occurs between inks different in color density, when an ink container containing a plurality of inks, which are identical in color but different in color density, is used.

Further, it is desirable that ink depletion can be easily recognized by the user. This is due to the following reason. That is, when urethane sponge or the like material is used as an ink retaining member in an ink container which comprises a plurality of ink chambers for separately holding different inks, it is rather difficult to detect whether one or more of the inks in the ink container have run out.

To describe in detail the aforementioned sealing method used during the transportation of an ink container, there are known various methods for sealing an ink container; for example, a method in which the ink delivery port of an ink container is sealed with a piece of film or the like which is pasted by adhesive, or welded, to the adjacencies of the ink delivery port of an ink container, and a method in which the ink delivery port of an ink container is sealed with a cap which is molded of resin or the like material and is fitted with an elastic sealing member.

Among these known methods, the method in which a piece of film is employed to seal the ink delivery port has the following problem. That is, when the piece of film is pasted to an ink container with adhesive, there is a problem in terms of the ink resistance of the adhesive, whereas when the piece of film is welded, there is a problem in that the number of usable resin materials is limited due to the fusability or the like of the film relative to the resin material for an ink container. In addition, when a sealing member in the form of a piece of film is employed, there is a possibility, though it will be rare, that the ink adhering to the film splashes as the user peels away the film from an ink container.

In comparison, in the case of the method in which a sealing cap is employed, it is possible that the hands of the user are soiled with the ink adhering to the sealing member of the cap. In order to eliminate such inconvenience, it is necessary to give a sealing cap such a structure that makes it difficult for the user to come in contact with the sealing surface of the cap. Also, obviously, it must be assured that a cap of this type will not come off easily during the transportation of an ink container.

Further, using a cap of this type (hereinafter, "transportation cap") to seal an ink container in which a plurality of inks of a different color are separately held in their own chambers, or to seal an ink container in which liquid customarily used to coagulate dye molecules dispersed in ink so that the water resistance or the like of the ink deposited on a recording medium is improved, and ordinary dye based ink, are held side by side, leaves a possibility that inks of different type mix among each other, resulting in ink color change. In particular, if the liquid for coagulating the dye molecules mixes with ordinary ink, the ink instantly coagulates and adheres to the adjacencies or build up in the adjacencies, and therefore, it is possible that ink fails to be properly supplied. Thus, such ink mixture must be prevented.

SUMMARY OF THE INVENTION

The primary object of the present invention is to accomplish a part of, or all of, the above objects by solving a part of, or all of, the problems described above, to provide such structures that are desirable for an ink container, in particular, an ink container with increased capacity, as well as for an ink container holder, an ink container cap, and the like, which pertain to an ink container with such a structure.

Another object of the present invention is to provide an ink container, an ink container holder, and an ink jet cartridge, which assure, in coordination with the structures described in the preceding object of the present invention, or independently therefrom, that an ink container is smoothly coupled with its counterpart in spite of the minuscule space available in a recording apparatus.

Another object of the present invention is to provide an ink container cap capable of preventing, in coordination with the above described features of the present invention, or independently therefrom, such color ink mixture that is traceable to ink leak which occurs when an ink container is installed into, or removed from an ink jet recording apparatus, or while an ink container is transported.

According to an aspect of the present invention which was made in order to accomplish the above described objects, an ink container for storing a plurality of recording inks, which is removably mountable in the ink container space of an ink container holder integrally comprising an Wink ejection head portion, comprises claw-shaped front projections which engage with corresponding locking holes cut in the front wall, relative to the direction of the ink container insertion, of the ink container holder; an elastic latch lever with a latch claw which locks into a locking hole cut in the rear wall of the ink container holder; and a pair of side projections, each of which is located on the outward surface of one of the lateral walls, next to the joint between the front and lateral walls, and corresponds to one of a pair of ink container holder's guide members located, one for one, in the lateral walls perpendicular to the aforementioned front and rear walls of the ink container holder, wherein in order to mount the ink container in the ink container holder, the ink container is first guided by the guide members of the ink container holder, and thereafter, it is rotated about the aforementioned claw-shaped front projections to be properly set in the ink container holder. Further, the ink container is provided with one or more grooves, which are cut in parallel to the inserting direction of the ink container, in the bottom wall, on the outward side, one for one in each interval between the adjacent two ink delivery ports among the plurality of ink delivery ports provided on the outward surface of the ink container.

According to the above described structure, the plurality of the ink delivery ports of the ink container are isolated from each other by one of the grooves cut in parallel to the inserting direction of the ink container, and therefore, even if ink leaks from one of the ink delivery ports, the leaked ink is prevented from reaching the adjacent ink delivery port and causing color ink mixture.

According to another aspect of the present invention, an ink container for storing a plurality of recording inks different in color density, which is removably mountable in the ink container space of an ink container holder integrally comprising an ink ejection head portion, comprises claw-shaped front projections which engage with corresponding locking holes cut in the front wall, relative to the direction of the ink container insertion, of the ink container holder; an elastic latch lever with a latch claw which locks into a locking hole cut in the rear wall of the ink container holder; and a pair of side projections, each of which is located on the outward surface of one of the lateral walls, next to the joint between the front and lateral walls, and corresponds to one of a pair of ink container holder's guide members located, one for one, in the lateral walls perpendicular to the aforementioned front and rear walls of the ink container holder, wherein in order to mount the ink container in the ink container holder, the ink container is first guided by the guide members of the ink container holder, and thereafter, it is rotated about the aforementioned claw-shaped front projections to be properly set in the ink container holder. Further, the ink container is provided with a plurality of ink delivery ports, each of which delivers ink different in color density from the other inks, wherein the ink delivery ports which deliver ink with higher color density are positioned on the claw-shaped front projection side, relative to the ink delivery ports which deliver ink with lower color density.

According to the above described structure, among the plurality of ink delivery ports located on the outward surface of the bottom wall of the ink container, those which deliver ink with higher color density are positioned on the front projection side, relative to the inserting direction of the ink container, and therefore, even if ink leaks from one of the ink delivery ports which deliver ink with higher color density, the leaked ink, which is higher in color density, is prevented from causing fatal color ink mixture by reaching the ink delivery port for low color density ink.

Further, according to another aspect of the present invention, an ink container holder comprises: a space in which an ink container, which stores recording ink, is inserted; locking holes which are cut in the front wall thereof, and in which the claw-shaped front projections of the ink container are engaged; a locking hole which is cut in the rear wall thereof, and in which the elastic latch lever, which extends diagonally upward from the bottom portion of the rear wall of the ink container, engages, wherein the ink container holder further comprises a pair of guide members, each of which is located on the inward surface of one of the lateral walls thereof which connect the front and rear walls thereof, in correspondence to the side projection provided on each lateral wall of the ink container, at the front edge, and wherein in order to mount the ink container in the ink container holder, the ink container is first guided by the guide members of the ink container holder, and thereafter, it is rotated about the aforementioned claw-shaped front projections thereof to be properly set in the ink container holder. Therefore, a relatively small space is required above the ink container holder for the ink container to be smoothly and reliably mounted in the ink container holder.

Further, according to another aspect of the present invention, an ink jet cartridge comprises: an ink container holder integral with an ink ejection head portion; and an ink container removably held in the space of the ink container holder; wherein the ink container stores a plurality of recording inks, and comprises claw-shaped front projections which engage in locking holes cut in the front wall of the ink container holder, an elastic latch lever which extends diagonally upward from the bottom portion of the rear wall and is provided with a latch claw which engages in a locking hole cut in the rear wall of the ink container holder; and the ink container holder comprises a pair of guide members, each of which is located on the inward surface of one of the lateral walls, and corresponds to the side projection provided on each lateral wall of the ink container, at the front edge; and wherein in order to mount the ink container in the ink container holder, the ink container is first guided by the guide members of the ink container holder, and thereafter, it is rotated about the aforementioned claw-shaped front projections thereof to be properly set in the ink container holder. Therefore, a relatively small space is required above the ink container holder for the ink container to be smoothly and reliably mounted in the ink container holder.

Further, according to another aspect of the present invention, an ink container is provided with a cap which is removably attachable to the ink container, wherein the cap comprises: elastic sealing members which seal, one for one, the plurality of ink delivery ports of the ink container; and a plurality of projections which are greater in length and height than the elastic sealing members, and each of which is placed between the adjacent two elastic sealing members; wherein the plurality of ink delivery ports of the ink container are isolated from each other as the projections of the cap are fitted, one for one, in the grooves cut in the bottom wall of the ink container, on the outward side. Therefore, color ink mixture which is liable to occur due to ink leakage or the like during the transportation of an ink container or at the beginning of ink container usage can be appropriately prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Figure 1:
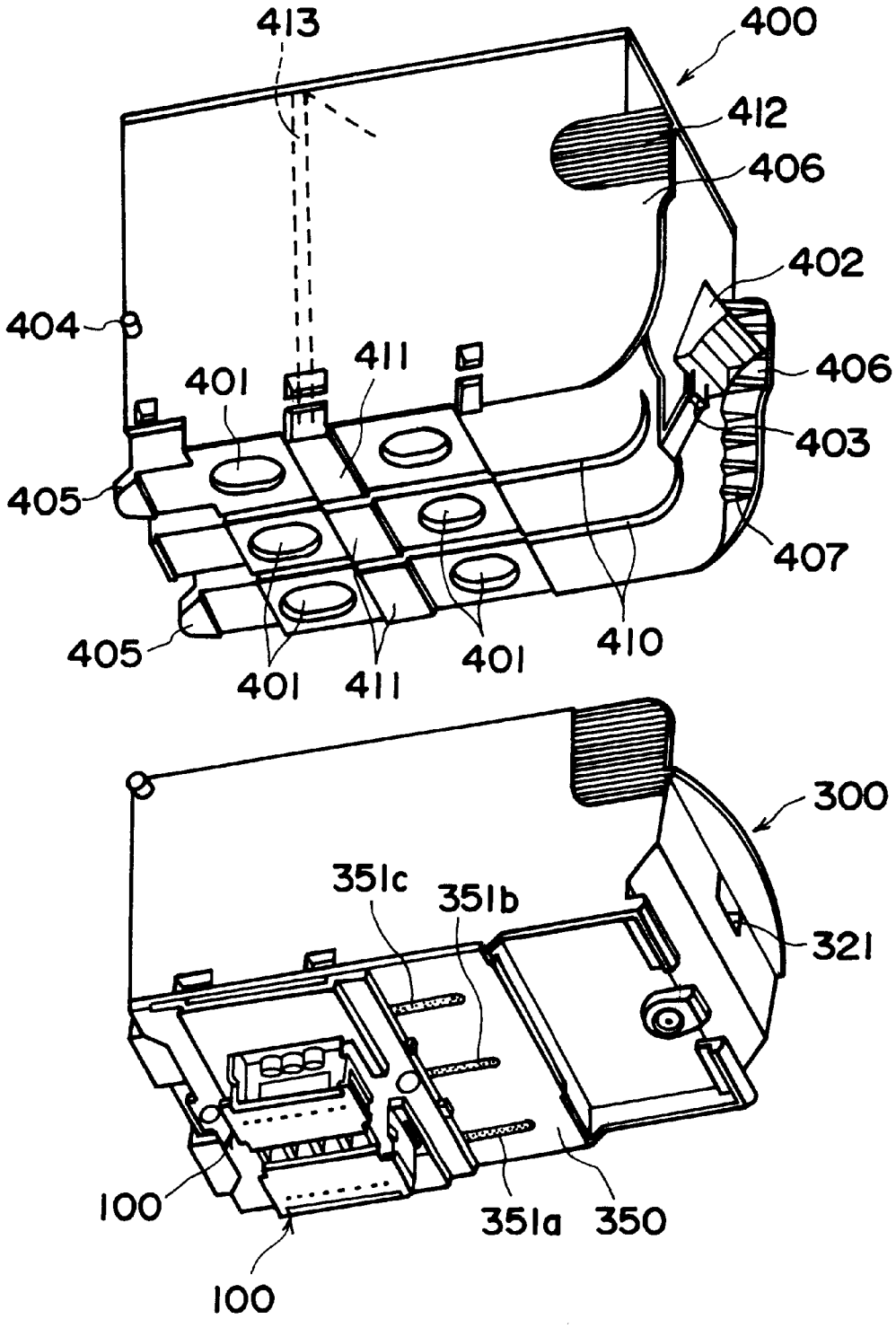
FIG. 1 is a perspective view of a holder and an ink container in the first embodiment of the present invention, wherein an ink jet head has been attached to the holder.
Figure 2:
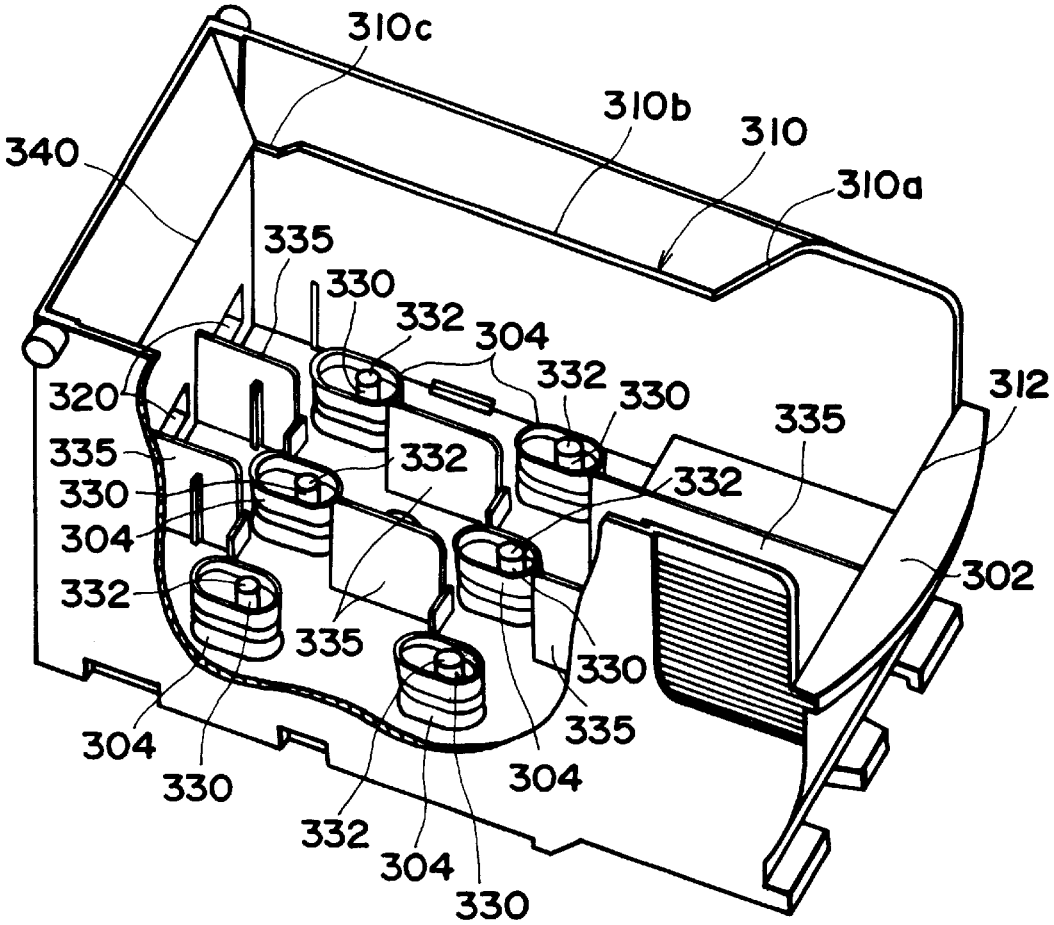
FIG. 2 is a perspective view of the same holder that is illustrated in FIG. 1, wherein the holder is partially broken.

FIG. 1 is a perspective drawing illustrating the ink container 400 and the holder 300 in the first embodiment of the present invention, wherein the holder 300 is on the carriage and is holding the ink container 400. The ink container 400 is seen from its ink delivery port side. FIG. 2 also is a perspective drawing illustrating the same ink container holder that is illustrated in FIG. 1, wherein the ink container holder 300 is partially broken to expose its joint portion which is joined with its counterpart on the ink container 400 side.

The holder 300 is integral with an ink jet head 100 as will be described later, and is removably mountable on the carriage of an ink jet recording apparatus. As depicted in FIGS. 1 and 2, the holder 300 is substantially in the form of a box which is open at the top. The top half of one of the lateral walls of the holder 300, that is, the rear wall relative to the direction of the ink container insertion, is missing, and from the top edge of this half size lateral wall, a flange 302 horizontally extends outward. The top half of the lateral wall of the holder 300, that is, the front wall relative to the direction of the ink container insertion, which opposes this half size wall is slanted diagonally upward. This slanted portion will be designated with a referential FIG. 340. Further, the holder 300 is provided with six chimney-like ink receiving pipes 330, each of which is located at the bottom, is surrounded with an elastic member 304, and is fitted with a filter 332. With this arrangement, each of six different inks held in the ink container 400 is enabled to be supplied to the corresponding ink jet head 100 as the ink container 400 is fitted into the holder 300. More specifically, as the ink container is inserted into the holder 300, the filter 332 of each ink receiving pipe 330 of the holder 300 comes in contact with the ink absorbing member provided at the ink delivery port 401 of the ink container 400, and at the same time, the elastic member 304 seals the joint between the ink delivery port 401 and the ink receiving pipe 330, inclusive of the peripheries of the ink delivery port 401, so that ink is smoothly supplied without ink evaporation and ink leakage. The elastic member 304 must be shaped so that its elasticity is fully utilized to seal the joint. For example, it may be shaped substantially like a crosswise cut piece of a trumpet; it may be shaped so that its section perpendicular to the lateral wall of the ink container 400 spreads toward the top end like an unfolded fan. Further, the holder 300 is provided with ribs 335, which are located on the inward surface of the bottom wall, and fit in the corresponding grooves 410 provided in the outward surface of the bottom wall of the ink container 400, as the ink container 400 is fitted in the holder 300. Not only can these ribs 335 increase the strength of the holder 300, but also they can serve as guides when the ink container 400 is inserted into the holder 300.

In addition, even if one of the inks in the ink container 400 is splashed from its ink delivery port during the insertion or removal of the ink container 400, the range of the splashed ink would be minimized due to the presence of the ribs 335, and therefore, the chance of the color ink mixture traceable to the adhesion of the splashed ink to the ink delivery ports for the other inks can be minimized.

In this embodiment, the rib 335 is not placed adjacent to the elastic member 304, but from the standpoint of color ink mixture prevention, it is desirable that the ribs 335 are extended across the adjacencies of the elastic member 304 far enough to reach the adjacent ribs.

Further, the holder 300 comprises a pair of parallel first guide portions 310 in the form of a guide rail. The first guide portions 310 are located on the inward surface of each of the parallel side walls of the boxy holder 300. It regulates the movement of the ink container 400, and also enables the ink container 400 to move smoothly, during the insertion or removal of the ink container 400. It comprises an inclined guide rail portion 310*a,* which descends downward from the top edge of the side wall, and a horizontal guide rail portion 310*b,* which extends substantially horizontally, and a recessed portion, which is in contact with the slanted portion 340 of the holder 300.

The holder wall with slanted portion 340 has three locking holes 320, which are located close to the bottom edge (close to the bottom wall of the holder 300) to be engaged, one for one, with the three claw-shaped projections 405 of the ink container 400 to prevent the ink container 400 from becoming dislodged. The bottom wall of the holder 300 is provided with an ink path formation member 350 comprising ink paths 351*a,* 351*b* and 351*c* which guide ink from the ink receiving pipes 330 to the ink jet head 100 (FIG. 1). The ink path formation member 350 is desired to be formed of transparent material so that the condition of the ink being guided to the ink jet head 100 through the ink paths 351*a,* 351*b* and 351*c* formed on the inward surface the ink path formation member 350, more specifically, whether or not bubbles or the like are in the ink, can be visually inspected through the ink path formation member 350 to confirm ink depletion which is signaled by the presence of bubbles in the ink. The structure of the holder 300 in this embodiment is such that three color ink paths 351*a,* 351*b* and 351*c* among six ink paths are visible. But it is unnecessary for all inks to be visible. For example, the uneasiness which the user of a printer or the like feels decreases just be being able to see one of the inks, for example, yellow ink, which is most frequently used.

Immediately below the flange 302 of the holder 300, a hole 321 is provided, in which the latch claw 403 of the latch lever 402 of the ink container 400 is engaged. During the insertion or removal of the ink container 400, the guide portion 312 of the flange 302 comes in contact with the bottom surface of the ink container 400 and functions as the second guide to guide the movement of the ink container 400.

Referring to FIG. 1, the ink jet head 100 is attached to the outward surface of the bottom wall of the holder 300, and its positional relationship relative to the carriage of an ink jet recording apparatus is accurately fixed as the holder 300 is mounted on the carriage which will be described later.

In this embodiment, each of yellow (Y), magenta (M), and cyan (C) colors are printed using two inks of different color density, a high color density ink and low color density ink. Therefore, the ink jet recording apparatus in this embodiment employs two ink jet heads 100, one for ejecting the high color density inks of Y, M and C colors, and the other for ejecting the low color density inks of Y, M and C colors. One head is provided with ejection outlet groups for Y, M and C color inks of high color density, and the other head is provided with the ejection outlet groups for Y, M and C color inks of low color density. Each ejection outlet group comprises a predetermined number of ejection outlets. The ink jet head 100 is provided with liquid paths and liquid chambers, the number of which corresponds to the number of the inks described above. Each liquid path, which leads to its own ejection outlet, is provided with an electrothermal transducer element which generates thermal energy for ink ejection. Each liquid chamber is supplied with specific ink through one of the ink receiving pipes 330 of the holder 300 or through the correspondent ink path 351*a*, 351*b* or 351*c*.

The internal space of the ink container 400 is divided by partitioning members into six separate chambers to separately hold the aforementioned six different inks. Each chamber is packed with a piece of porous ink absorbing material, which fills most of the internal space, and retains ink based on capillary force. The bottom wall of each ink chamber is provided with ink delivery port 401, and the ink retained in the ink absorbing member is supplied to the ink jet side through this ink delivery port 401. Each ink delivery port 401 is provided with a fibrous ink absorbent member, which will be described later with reference to FIG. 5, and the capillary force of this ink absorbent member is rendered greater than that of the ink absorbing member packed in the ink chamber to retain ink, assuring that ink is desirably fed out of the ink chamber.

The positioning of the ink delivery ports 401 is decided in the following manner.

The position of the ink delivery port 401 of each ink chamber for ink of a different color must be decided mainly in consideration of concerns that if ink should leak from the ink delivery port 401, not only must soiling of the ink container itself be minimized, but also color ink mixture or the effects of color ink mixture must be minimized. During the insertion or removal of the ink container 400, the user is to handle the ink container 400 by grasping the handhold portion 412 of the ink container 400. While the ink container 400 is held by the hand of the user, the projections 405, which project from the front edge of the bottom wall of the ink container 400, relative to the direction in which the ink container 400 is inserted, should be the bottommost portion of the ink container 400.

In this case, in order to minimize the soiling of the ink container itself traceable to ink leakage, the ink delivery port 401 is desired to be located closer to the projection 405 than the handhold portion 412 is, so that the area which might be soiled by the leaked ink becomes smaller.

In order to prevent the Y, M and C color inks from being mixed with each other, the positional relationship among the plurality of the ink delivery ports 401 must be such that while the user is holding the ink container 400, none of the ink delivery ports 401 is in the possible flow path of the ink which might leak from the other ink delivery ports 401. Therefore, in this embodiment, the ink delivery ports 401 of the Y, M and C color ink chambers of both the ink jet head for the high color density ink and the ink jet head for the low color density ink are aligned in the direction perpendicular to the direction in which leaked ink flows while the ink container 400 is held by the user; they are aligned in the direction perpendicular to the direction in which the groove 410 extends.

As for the positional relationship between the ink delivery ports 401 for two inks with the same color but different color density, the ink delivery port for the ink with low color density is positioned on the upstream side relative to the direction in which the leaked ink will flow while the ink container 400 is oriented as described above. This is because such a positional arrangement minimizes the effects of color ink mixture even if one ink comes in contact with the other ink by coming in contact with the ink delivery port of the other ink; when the high color density ink contaminated with the light density color ink of the same color is used for recording, the effects of the color ink mixture are not as conspicuous as otherwise.

Positioning the ink delivery ports 401 as described above also suits the relationship between the high and low color density inks well in terms of their volume. That is, from the standpoint of consumption, more high color density ink than the low color density ink should be retained in the ink container 400. More specifically, referring to FIG. 1, the two ink chambers in the ink container 400, for two inks with the same color but different color density, respectively, are separated with a partitioning wall 413. In the same drawing, the high color density ink is contained on the left side, and the low color density ink is on the right. This arrangement perfectly agrees with the above described positioning of the ink delivery ports 401 of the ink chambers for the high and low color density inks. Therefore, the ink container structure pertaining to the positioning of the ink delivery ports 401 can be simplified. In other words, when the ink delivery ports 401 are positioned as described above, it is unnecessary to provide the ink container 400 with elaborate ink paths to connect the ink delivery ports 401 to the corresponding ink outlets, making it possible to simplify the structure of the ink container 400 pertaining to the ink delivery ports 401.

Further, according to the above described relationship between the ink chambers for the high and low color density inks in terms of positioning and capacity, the bottom wall of the ink chamber for the low color density ink is rendered larger, and therefore, more latitude is afforded in designing the ink container 400 to place the light color density ink outlet 401 as close as possible to the projection 405 while satisfying the aforementioned requirement for the positional arrangement of the ink delivery ports 401.

Also in this embodiment, from the standpoint of the prevention of color ink mixture, a projection 411, the length of which is greater than the diameter of the ink delivery port 401, is provided between the two ink chambers for inks with the same color but different color density, in addition to properly positioning the ink delivery ports 401 as described above. Further, a groove 410 is placed between the adjacent two ink delivery ports 401 for inks with different color. With the provision of these projections and grooves, even if ink leaks, the flow of the leaked ink is blocked or diverted before it reaches the other ink delivery ports.

The ink container 400 is provided with a latch lever 402, which is integrally formed with the ink container wall on the rear side, relative to the inserting direction of the ink container 400. It is located closer to the bottom than the handhold portion 412. It elastically and rotatively flexes about the base end at which it is connected to the ink container 400, and immovably locks the ink container 400 in the holder 300. It is provided with a latch claw 403, which is located approximately at the center of the latch lever 402. The ink container 400 is provided with another projection 404 as a guide, in addition to the plurality of aforementioned projections 405. The projection 404 is located on the side wall, right next to the front edge, at the approximate center of the front edge. Further, each side wall of the ink container 400 extends rearward past the rear wall with the latch lever 402, and forms a side wall extension 406 which constitutes a part of the handhold portion 412.

Figure 3:
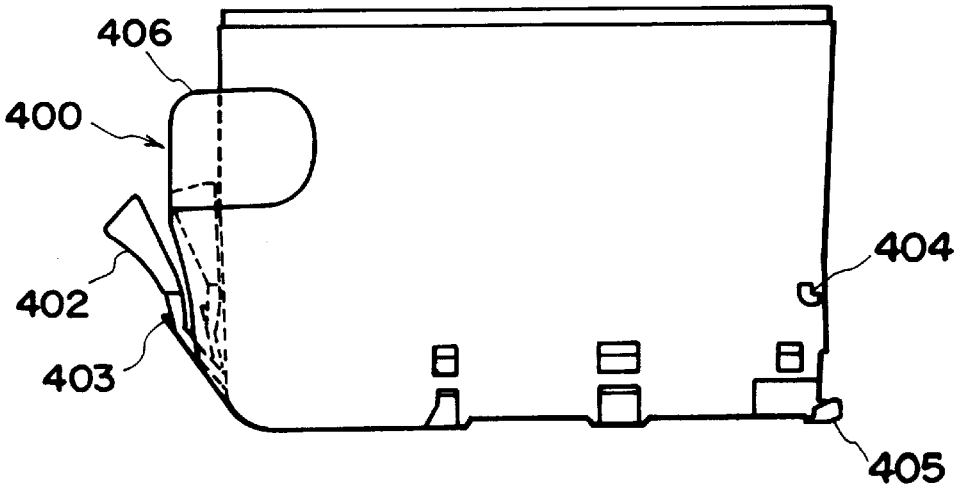
FIG. 3 is a schematic drawing which depicts the function of the extended portion of the lateral wall of an ink container.

Referring to FIG. 3, the latch lever 402 extends diagonally upward from the rear wall of the ink container 400, from the location near the bottom of the ink container 400. As shown in the drawing, normally, that is, when the ink container 400 is out of the holder 300, the latch lever 402 takes the position outlined by the solid line, due to the elasticity of the base portion of the latch lever 402, whereas when the ink container 400 is placed in the holder 300, it can elastically flex as it comes in contact with the flange 302, and as the latch claw 403 engages in the locking hole of the holder 300, it takes a position at which it locks the ink container 400 in the holder 300.

The latch lever 402 also elastically flexes as described above as external force impacts the ink container, for example, when the ink container falls. Whether it is during the mounting or the moment of impact, the latch lever 402 is capable of elastically flexing as far as the position outlined by the broken line in FIG. 3, and therefore, the force applied to the ink container by the members with which the ink container comes in contact or engages, or the force from the impact, ultimately acts on the side wall extension 406.

In other words, in the case of the position outlined by the broken line in FIG. 3, the entire latch lever 402 is within the space surrounded by the side wall extension 406; the side wall extension 406 extends in the rearward direction farther than the thickness of the latch lever 402.

With the provision of the above arrangement, it is the side wall extension 406 of the ink container 400 that mainly stays in contact with the flange 302 of the holder 300 during the mounting of the ink container 400 into the holder 300 or the like operation. In addition, the contour of the side wall extension 406 forms a smooth curvatures. Therefore, the ink container 400 can be smoothly mounted or put through the like operation. Further, even when the latch lever 402 is subjected to an impact, the force of the impact is ultimately taken by the side wall extension 406, being prevented from fatally affecting the latch lever itself. Further, the base portion, that is, the support portion, of the latch lever, at which the flexibility of the latch lever, which comes from the elasticity of the latch lever material, is relatively small, is completely covered by the side wall extension 406 as seen from the widthwise direction of the ink container, regardless of the state of the elastic flexing of the latch lever. Therefore, external force is prevented from directly impacting the base, or support, portion of the latch lever 402.

The side wall extension 406 extends upward from the bottom almost all the way to the top edge of the ink container. The reason why the side wall extension 406 is not extended all the way to the top is because if the side wall extension 406 is extended all the way to the top edge of the ink container, it is possible for the side wall extension 406 to partially or entirely break off when the side wall extension 406 is subjected to the impact from the falling of the ink container or the like incidents. Thus, the side wall extension 406 is extended fairly close, but not all the way, to the top edge, so that the external force is prevented from directly impacting the side wall extension 406. As for the configuration of the side wall extension 406 toward the bottom of the ink container where the base, or support, portion of the latch lever is located due to the engagement between the latch lever and the holder, which will be described later, the height of the side wall extension 406, relative to the side wall edge, is gradually reduced toward the bottom of the ink container so that the contour thereof forms a slight curvature. Therefore, not only is the side wall extension 406 prevented from being damaged by the external impact, but also it makes smooth the insertion of the ink container into the holder as described above. Further, the side wall extension 406 in this embodiment is provided with reinforcement ribs 407 which reinforce the side wall extension 406, and therefore, the reliability of the side wall extension 406 is further increased.

With the provision of the above described structure, it is assured that the latch lever 402, which plays an essential role in mounting or dismounting the ink container 400, is protected to guarantee trouble free insertion or removal of the ink container.

Although in this embodiment, the latch lever 402 is protected by extending the lateral walls of the ink container, the selection of the protective member for the latch lever does not need to be limited to the extended portion of the lateral wall. The protective member may be a pair of projections extending in parallel to the latch lever, in a manner of sandwiching the latch lever, from the base portion of the latch lever to the free end.

The above described ink container 400 is mounted in the above described holder 300 in the following manner. First, the claw-shaped front projection 405 of the ink container 400 is aligned with the locking hole 320 of the holder 300, and is inserted therein. Next, the latch claw 403 of the latch lever 402 located on the opposite side of the ink container 400 is engaged in the locking hole 321 of the holder 300. Thus, the ink container 400 is held in the holder 300 by both the front and rear walls, being accurately positioned in the holder 400, and as a result, the ink container and the holder are securely united with each other.

Figure 4:
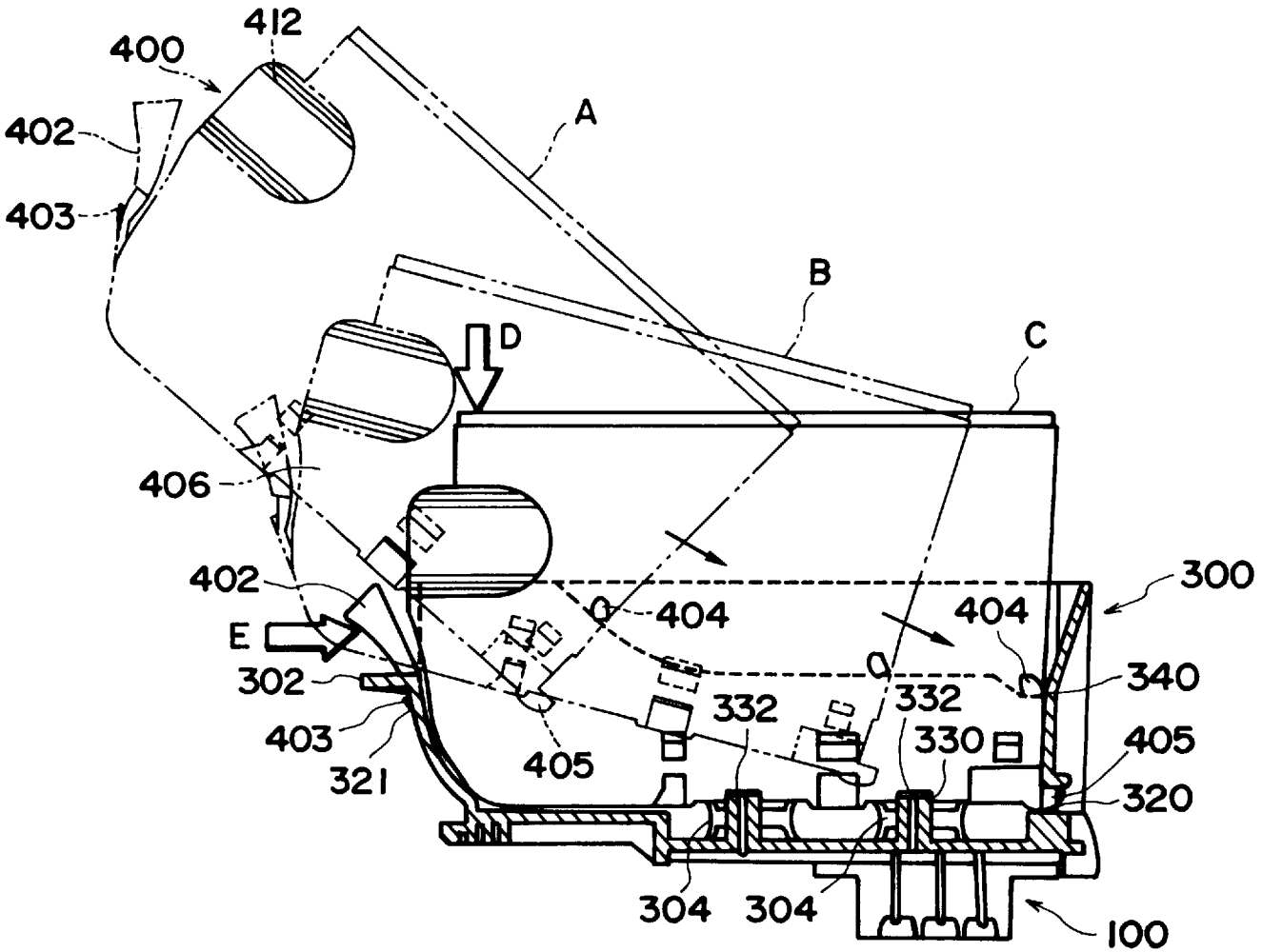
FIG. 4 is a side elevation of a holder and an ink container, and depicts the stages the ink container goes through when engaged with the holder.

FIG. 4 depicts the movement of the ink container 400 which occurs while the ink container 400 is mounted into the holder 300.

The position designated by a referential figure A is where the ink container 400 is in the first stage of the insertion of the ink container 400 into the holder 300, and the position designated by a referential figure B is where the ink container 400 is in the intermediary stage of the insertion, in which the movement of the ink container 400 toward the final position designated by a referential figure C is regulated by the guide member 310.

First, the ink container 400 is placed against the holder, with the end opposite to the latch lever being positioned at the front end relative to the inserting direction, as indicated by the position A, and then is inserted into the holder 300. As the ink container 400 is inserted, the side projection 404 of the ink container 400 which is located on the outward surface of the lateral wall, at a position right next to the front edge and a predetermined distance above the bottom, comes in contact with the slanted guide rail portion 310*a* of the guide portion 310 of the holder 300, and follows it. Then, as the ink container 400 is inserted farther, the projection 404 slides onto the horizontal guide rail portion 310*a* and follows it. In this stage of the ink container insertion, the only thing the user has to do in order to smoothly insert the ink container 400 is to simply push the ink container by grasping the handhold portion 412 of the ink container 400, because the side projection 404 located at the front of the ink container 400 is supported by the guide member 310. In addition, the vertical distance between the projection 404 and the bottom of the ink container 400 is rendered smaller than the vertical distance between the horizontal guide rail portion 310 provided on both lateral walls and the top end of any of the plurality of the ink receiving pipes ("vertical" here means the direction perpendicular to the plane passed through the guiding surfaces of the pair of the horizontal guide rail portions). Therefore, the ink container 400 can be inserted into, or removed from, the holder 300, with no interference between the bottom of the ink container 400, and the ink receiving pipes or the like provided on the inward surface of the bottom wall of the holder 300. In other words, it is unnecessary to give the ink container 400 a special shape to prevent the above described interference. Thus, according to this embodiment, the ink capacity of the ink container 400 can be maximized while enabling the ink container 400 to be smoothly inserted into, or removed from, the holder 400.

After going through the stage correspondent to the position B in FIG. 3, the ink container 400 moves toward the position C, the ultimate position. In this final stage of insertion, the projection 405 located at the bottom front edge of the ink container 400 is inserted into the locking hole 320 of the holder 300, and then is locked therein. Next, the rear portion of the ink container 400 is pushed by the user in the direction of an arrow mark D, whereby the latch lever 402 rides over the guide member 312 located at the inward edge of the flange 302, and the latch claw 403 of the latch lever 402 locks with the edge portion of the locking hole 321. Through this final stage, the ink delivery ports 401 of the ink container 400 are securely connected to the corresponding ink receiving pipes of the holder 300. Further, during the rotational movement of the ink container 400 which occurs while the ink container 400 is inserted into the holder 300, the latch lever 402 is caused to elastically bend into the space surrounded by the left and right side walls, being therefore prevented from interfering with the flange or the like of the holder. Therefore, smooth motion is possible during the insertion or removal.

During the ink container insertion sequence described above, the ribs 335 of the ink holder fit in the corresponding grooves 410 of the ink container 400, playing a role as an auxiliary means for positioning the ink container relative to the holder; they function as auxiliary guides to assist the ink container to be smoothly inserted along the guide members.

As described before, the ink receiving pipes 330 come in contact with the correspondent ink absorbent members placed at the correspondent ink delivery ports of the ink container 400 as the ink container 400 settles into the ultimate ink container position C illustrated in FIG. 4, assuring that ink is desirably supplied. Further, the during the final movement of the ink container 400, the elastic member 304 provided around the top edge of the ink receiving pipe is vertically deformed to seal the periphery of the ink delivery port 401, and the periphery of the top edge of the ink receiving pipe 303 of the holder 300, so that even if ink leakage were to occur, the leaked ink would be prevented from spreading farther.

Next, in order to remove the ink container 400 from the holder 300, the following steps are followed. First, the latch lever 402 must be pressed in the direction of an arrow mark E in FIG. 4 to disengage the latch claw 403 from the edge portion of the locking hole 321. After the latch claw 403 is disengaged, the ink container 400 must be pulled out by holding the rear portion of the ink container 400. As the ink container 400 is pulled outward, the projection 405 of the ink container 400 is pulled out of the locking hole 320 of the holder 300, and at the same time, the projection 404 is pulled out of the recessed portion 310*c*. Thereafter, the ink container 400 comes out of the holder along the guide 310, following in reverse the aforementioned insertion sequence.

While the ink container 400 is inserted into, or removed from, the holder 300, the ink container 400 remains tilted, and therefore, it is possible to minimize the space necessary above the ink container 400 for the insertion or removal of the ink container 400, and therefore, the vertical measurement of the main assembly of an ink jet recording apparatus can be reduced.

The reaction force which the ink container 400 receives from the holder 300 when the ink container is inserted in the holder 300 is a total of a reaction force F1 from the deformation of the elastic member 304, a reaction force F2 from the pushing of the ink retaining member in the ink container 400 by the ink receiving pipe 330, and a reaction force F3 from the deformation of the latch lever 402. However, in the case of an ink container which contains a large selection of inks to satisfy not only simple color requirements but also color density requirements, the aforementioned reaction force which the ink container 400 receives is substantially proportional to the number of inks (number of joints). For example, when an ink container contains six different inks as the ink container in this embodiment does, it receives a reaction force six times larger than an ink container which contains a single ink. Therefore, when an elastic material which tends to generate a large reaction force is used as the material for a sealing member, it is desirable that the sealing member is not shaped like a conventional, ordinary O-ring, but is shaped like a crosscut piece of a chimney or a trumpet, as the elastic member 304 in this embodiment is shaped. This is for the following reasons. That is, in order to seal a joint using a sealing member shaped like an O-ring, the sealing member has to be simply compressed, or flattened, enough to seal the joint, and therefore, relatively large pressure has to be applied, whereas in the case of a sealing member shaped like the one in this embodiment, which not only flattens to seal the joint, but also elastically deflects to seal the joint, and therefore, the pressure which must be applied to the sealing member in this embodiment is not as large as the pressure which must be applied to the conventional O-ring shaped sealing member, reducing thereby the reaction force from the sealing member.

As is evident from FIG. 1, in this embodiment, the ink delivery ports of the ink container 400 are substantially symmetrically arranged relative to the central axis of the ink container 400 in the direction in which the ink container 400 is inserted or removed, and therefore, the aforementioned reaction force also becomes symmetrical relative to the same central axis of the ink container 400. As a result, not only can the movement of the ink container 400 during its insertion or removal be stabilized, but also uniform pressure can be applied to the joints between the ink delivery ports and the corresponding ink receiving pipes.

Further, it is desirable that the distance from the position of the joint, that is, the position of the ink receiving pipe 330, to the locking hole 320, the position of which coincides with the position of the fulcrum around which the ink container 400 rotates, is rendered half the distance from the locking hole 320 to the rear end portion of the holder 300 (position by which the user pushes the ink container 400), in order to reduce the pressure which the user must apply to the ink container 400 when inserting the ink container 400.

As described above, according to this embodiment, the ink container 400 can be smoothly and securely mounted in the holder 300 with the use of only a small amount of force. This means that it is unnecessary to apply excessive force to an ink container to mount it in a holder, preventing thereby ink leakage from the ink delivery port or ink receiving pipe which might occur when an ink container is inserted or removed.

Figures 1, 5A:
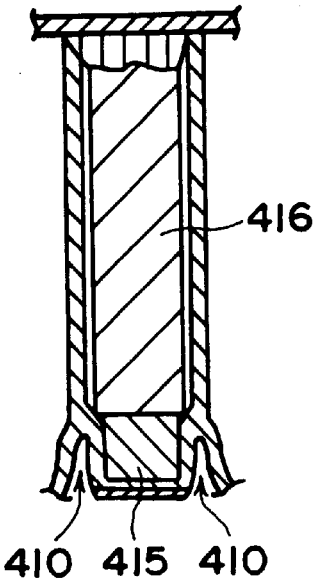
Figures 2, 5A:
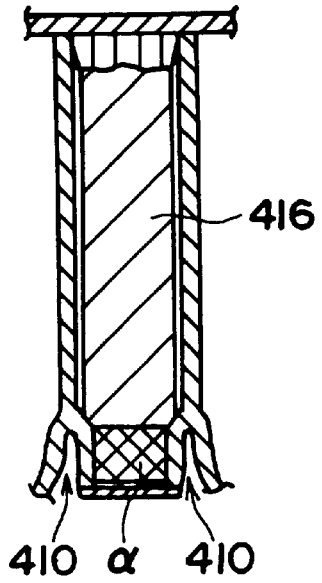
Figure 5B:
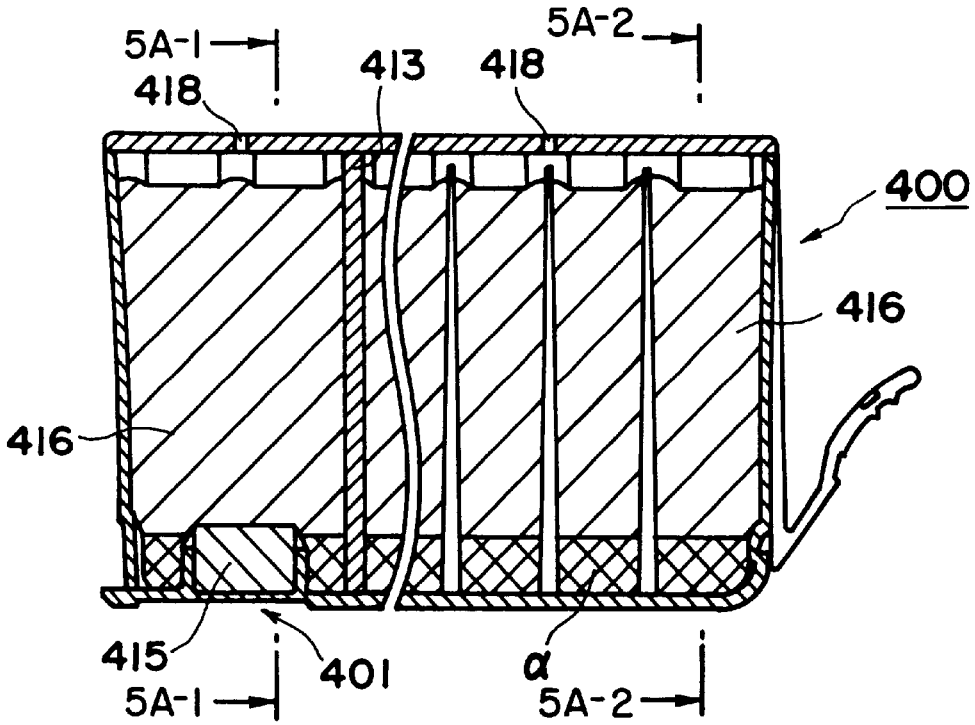
FIG. 5 provides sections of an ink container, 5A–1 AND 5A–2 presenting the widthwise vertical sections, and 5B being the lengthwise vertical section, and depicts the compressed state of an ink absorbing member in an ink container.

FIG. 5 depicts the state of an ink absorbing member which has been compressed into the ink container, in this embodiment, to retain ink. FIGS. 5A–1 and 5A–2 present cross-sections of the ink container illustrated in FIG. 5; 5B is taken at the planes 5A–1 and 5A–2 in FIG. 5. These drawings depict the structure of only one among the ink chambers for Y, M and C color inks, wherein the ink delivery port 401 of the ink chamber for a low color density ink is not illustrated.

As described before, in each of the high color density ink chambers and the low color density ink chambers, an ink absorbing member 416 is stored, and retains the high color density ink and the low color density ink, respectively. Referring to the section of the ink absorbing member 416 at the plane in FIG. 5A1 the bottom portion a of the ink absorbing member 416 is compressed in the crosswise direction because there is the aforementioned groove 410 between the adjacent two ink chambers. With this crosswise compressing of the bottom portion α, not only is it possible to prevent ink from unnecessarily seeping out from the bottom portion α of the ink absorbing member 416, but also it is possible to retain ink adjacent to the ink delivery port in order to assure reliable ink delivery even if an ink container is stored for a long time, with the ink delivery port side facing upward, during the transportation of an ink container.

Further, a fibrous ink absorbing member 415, which is separate from the ink absorbing member 416, is placed at the ink delivery port 401, as described above. Therefore, the ink absorbing member 416 is compressed in the ink flow direction, immediately above the ink absorbing member 416, as illustrated by the hatched portions in FIG. 5A–1, and the section in FIG. 5B. As a result, the capillary force generated in this portion is rendered larger than that in the rest of the ink absorbing member 416. Consequently, the ink collects in the area immediately above the ink delivery port, making it possible to desirably deliver the ink.

Each ink chamber is provided with an air vent 418.

As for the material for various components, the holder 300 is desired to be formed of highly impact resistant material, because the holder 300 must be able to withstand the impact generated when the holder 300 falls while holding the ink container 400, which is much heavier than the holder 300. The material for the ink path formation member 350 is desired to be transparent, and in terms of efficiency in producing an ink jet head, it is desired to be weldable to the holder 300. As for the materials capable of satisfying the above requirements, denatured polyphenylene oxide (PPO) can be used as the material for the holder 300 while using transparent polystyrene as the material for the liquid path formation member 350.

Figure 6:
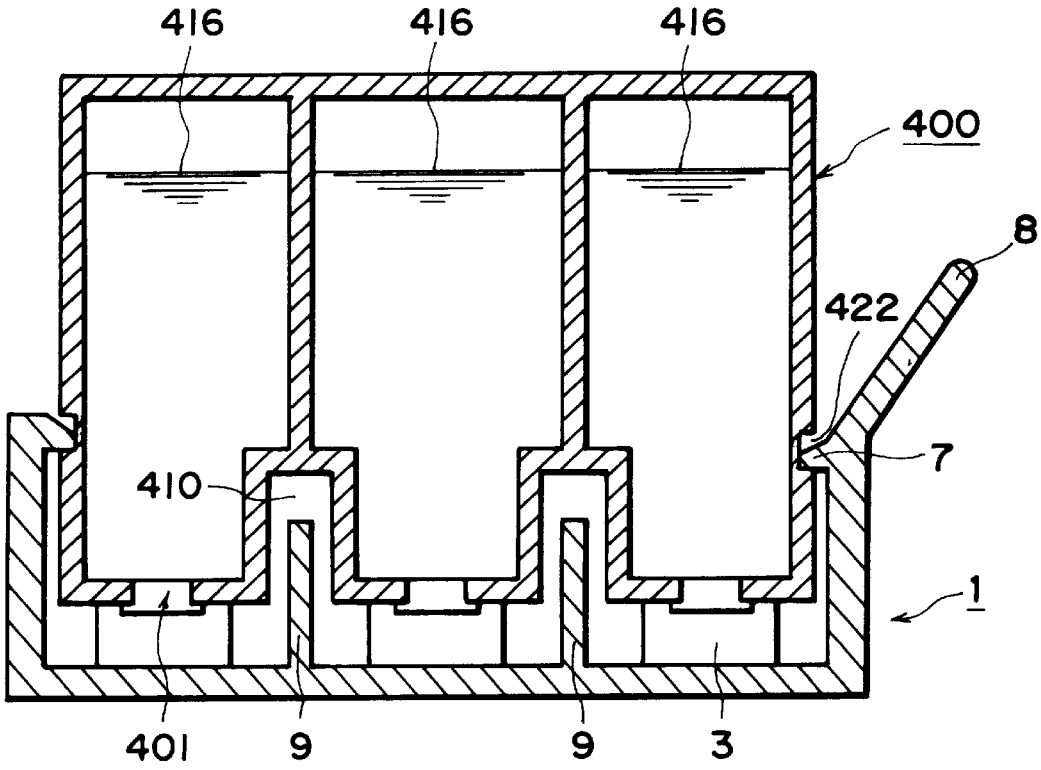
FIG. 6 is a side elevation of an ink container fitted with a transportation cap which is used during the transportation of an ink container.
Figure 7:
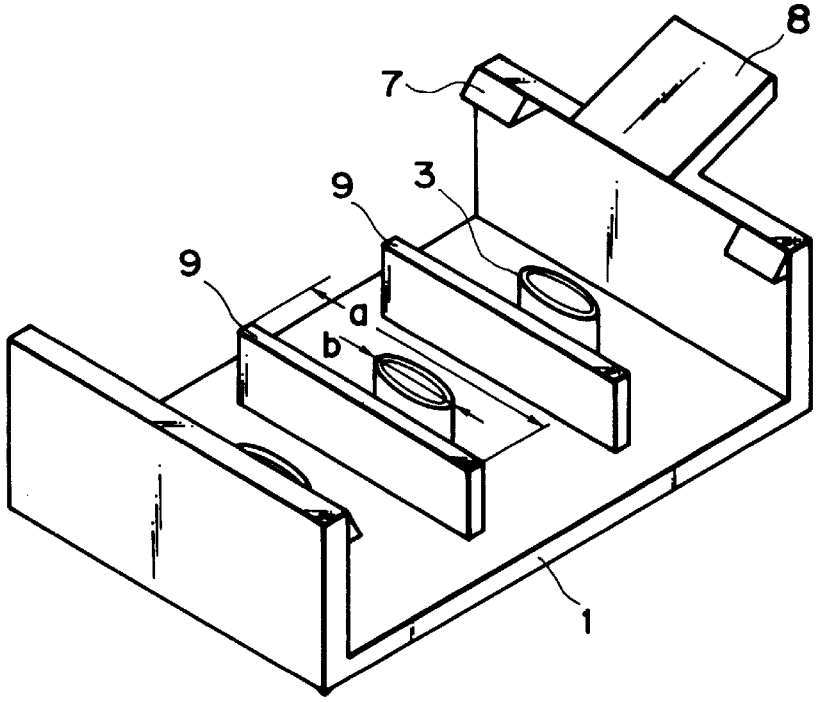
FIG. 7 is a perspective view of the transportation cap illustrated in FIG. 6, and depicts the relationship among the functional portions of the transportation cap in terms of size.

FIG. 6 is a sectional drawing which depicts the above described ink container 400 fitted with a cap (hereinafter, "transportation cap") used during the transportation of the ink container 400. FIG. 7 is a schematic perspective view of the same cap that is illustrated in FIG. 6. In FIG. 6, referential FIGS. 1 and 400 designate the transportation cap and the ink container, respectively.

The transportation cap 1 in this embodiment is molded of resin material such as polypropylene. However, the material for the transportation cap 1 does not need to be limited to the material used in this embodiment; other materials are acceptable. The transportation cap 1 is provided with a plurality of projections 9, which are integrally molded with the cap 1. A referential FIG. 3 designates an elastic sealing member, which seals the ink delivery port 401 of the ink container 400. It is formed of elastomer, and is molded together with the cap 1 by two color injection molding, being thereby fixed to the main structure of the cap 1. The material for the elastic member 3 is also not limited to elastomer. For example, rubber material may be used. As for the method to fix the elastic member 3 to the cap 1, the elastic member 3 may be simply attached utilizing the elasticity thereof, instead of using two color injection molding.

As described before, the ink container 400 has a plurality of ink chambers, each of which is dedicated to one of Y, M and C color inks, and stores an ink retaining absorbing member.

In handling the ink container 400 while transporting it or in a similar situation, the transportation cap 1 capable of preventing ink leakage from the ink delivery port 401 which occurs when the ink container 400 falls, and also preventing ink evaporation from the ink delivery port 401, is securely attached to the ink container 400 so that it will not easily come off.

The transportation cap 1 is fixed to the ink container 400 by fitting the cap lock portion 7 of the finger tab 8 into the correspondent recesses located in the side walls of the ink container 400. As a result, the periphery of the ink delivery port 401 is sealed by the elastic member 3 of the cap 1 to prevent the leakage, evaporation, and the like, of ink.

It is possible that the ink within the ink container 400 may leak due to the impact caused by the fall, vibration, or the like, which occurs during transportation or in the like situation, and flows as far as the elastic member 3. If such a situation should occur, a certain amount of the ink which is caused to leak by the impact would be drawn back into the ink container 400 by the ink absorbing member 416, but the rest of the leaked ink may remain on the elastic member 3, although it is only a small amount. The amount of the ink which fails to be drawn back into the ink container 400 and remains on the elastic member 3 can be reduced by reducing the gap between the elastic member 3 and the ink container, but cannot be completely eliminated. The ink which remains on the elastic member 3 is liable to spatter, for example, when the user removes the transportation cap 1 from the ink container 400. When this happens, that is, when cyan ink, for example, which is adhering to the elastic member 3, spatters and adheres to the ink delivery port 401 of the yellow ink, the cyan ink is liable to be drawn into the-yellow ink chamber, and change the color of the yellow ink.

Thus, in this embodiment, a projection 9 which is taller than the elastic member 3, is placed between the adjacent elastic member 3 which seal the ink delivery port 401, so that the ink having adhered to the elastic member 3 does not spatter and enter the chamber of a different color ink. Further, referring to FIG. 7, the length a of the projection 9 is rendered longer than the length b of the actual sealing edge of the elastic member 3. In this embodiment, the length a is approximately 18 mm, whereas the length b is approximately 15 mm. Further, as illustrated in FIG. 6, maze-like gaps are formed by the projections 9 and the grooves 410 of the ink container 400, and therefore, even if ink leaks out from between the ink delivery port 401 and the elastic member 3 during the transportation of the ink container 400, the leaked ink is prevented by these mazes from easily reaching the adjacencies of the ink delivery port 401 of any of the ink chambers for other color inks. Therefore, it can be further assured that color ink mixture is prevented. In this embodiment, the distance the projection 9 is inserted into the groove 410 is approximately 2 mm, but since the width of the groove 410 is in a range of 2 mm–3 mm, which is relatively narrow, maze-like gaps which are very effective can be formed.

Further, the projection 9 provides the cap 1 with resistance to torsional deformation relative to the plane of the cap bottom with which the projection 9 is integral, making it difficult for the cap 1 to come off. Further, when an ink container is of a type which stores a plurality of color inks as the ink container 400 in this embodiment does, the cap 1 must be wider, and therefore, it is more liable that after the cap 1 is removed from the ink container, the user's hand will come in contact with the elastic member 3 to which ink is adhering. However, the provision of the projection 9 can prevent the user's hand from being soiled by coming in contact with the elastic member. Further, the vertical side walls (portions integral with the projections 7) of the cap 1 are rendered taller than the projections 9, and therefore, even if ink is on the projection 9, the user can prevented from accidentally soiling his/her hand with the ink on the projection 9.

In order to increase the ink capacity of an ink container which stores a plurality of color inks as described above, by reducing wasteful space as much as possible while keeping the ink container size relatively small, it is desirable to reduce as much as possible the width of the groove 410 into which the projection 9 of the cap 1 is fitted. Further, in order to prevent the ink on the elastic member 3 from spattering, the projection 9 is desired to be as high as possible. However, in reality, if the above requirement is satisfied, that is, if the projection 9 is rendered as high as possible and the gap 410 is rendered as narrow as possible, in this embodiment, the projection 9 is liable to fit too rightly in the groove 410, which may complicate a cap removal operation. In order to overcome this problem, the projection height and the groove width should be balanced relative to each other in their designs.

Another possible solution is to render the projection 9 elastic by forming the projection 9 of the same material as the material for the elastic member 3, so that even if the projection 9 gets caught in the groove of the ink container, the cap 1 can be easily pulled off the ink container because of the elasticity of the projection 9. In this case, it is possible to integrate the projection 9 with the elastic member 3 to reduce the number of gates to one, so that the apparatus for molding the cap 1 can be simplified.

Figure 8:
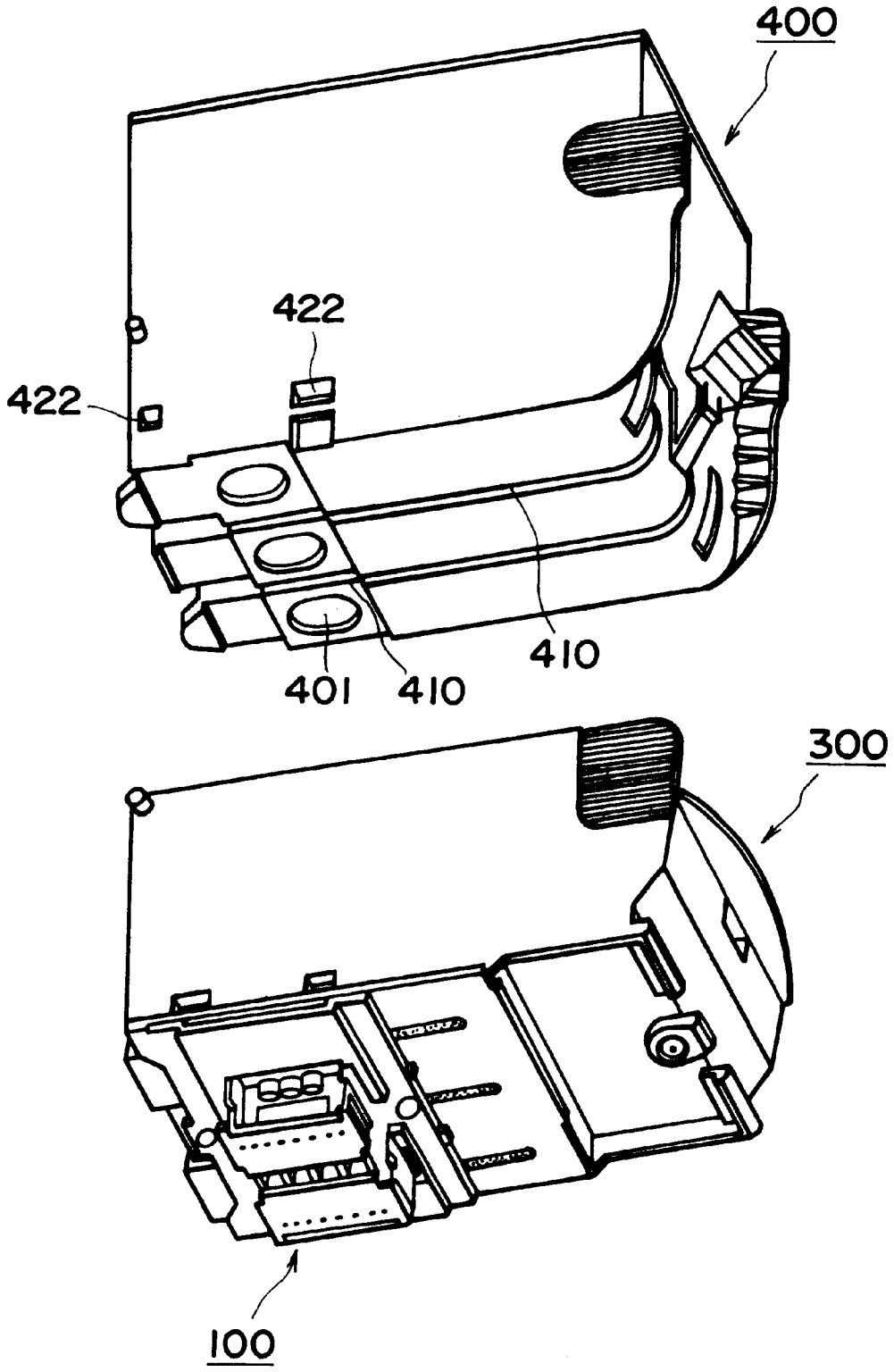
FIG. 8 is a perspective view of the ink container and the ink holder in the second embodiment of the present invention.
Figure 9:
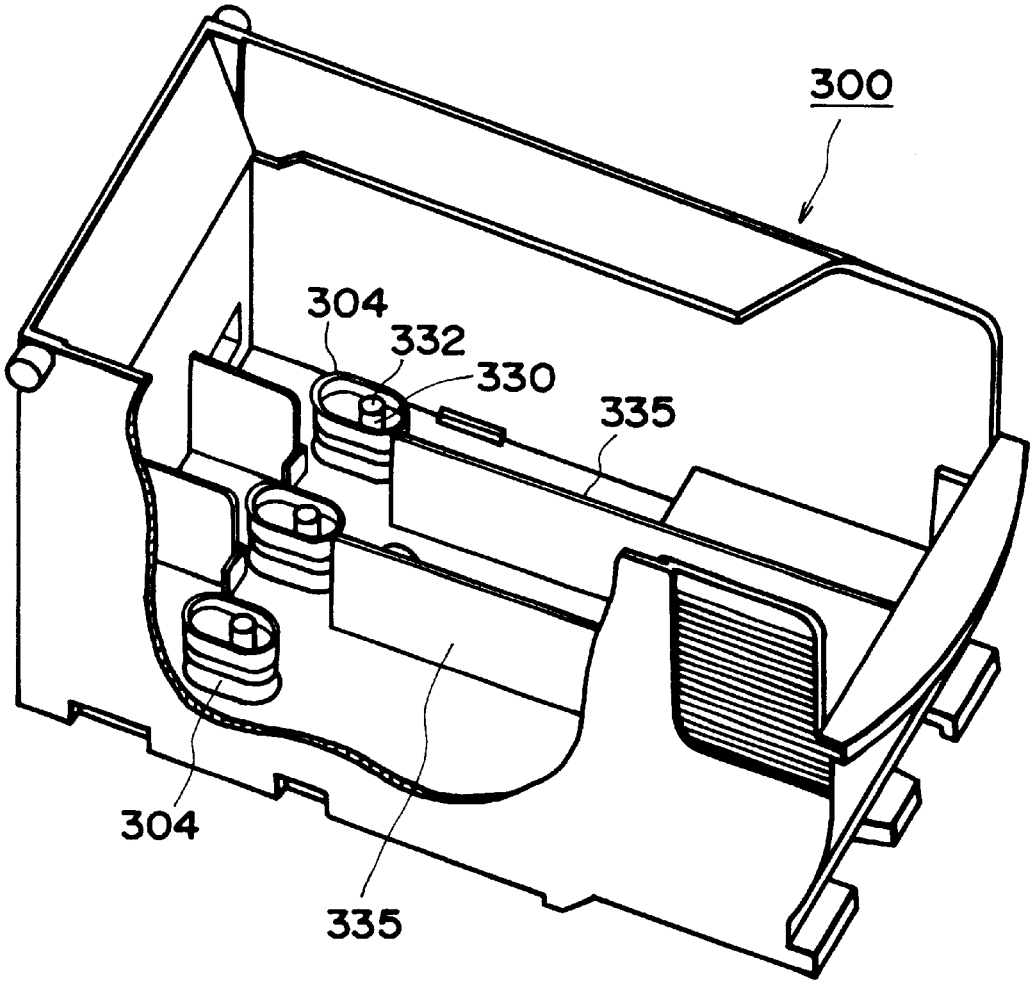
FIG. 9 is a perspective view of the holder illustrated in FIG. 8, wherein the holder is partially broken.

FIGS. 8 and 9 illustrate the ink container and the holder therefor in another embodiment of the present invention, and are comparable to FIGS. 1 and 2, respectively.

The ink container and the holder in this embodiment are designed to accommodate three different inks, for example, Y, M and C color inks. The present invention is also applicable to this type of set-up.

Figure 10:
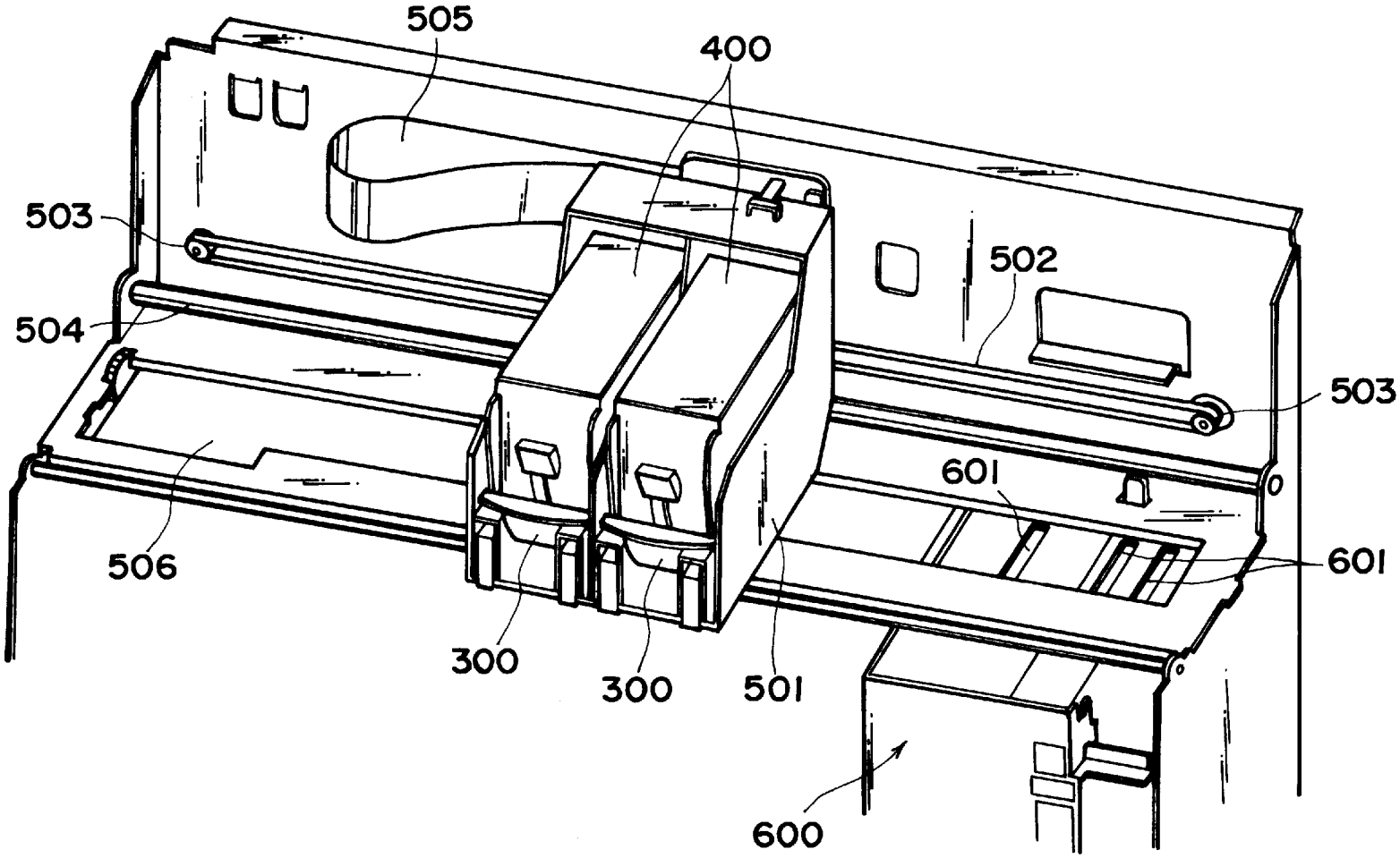
FIG. 10 is a perspective view of a part of the ink jet recording apparatus in the first embodiment of the present invention, and shows the general structure in the adjacencies of the operating range of the recording head.

FIG. 10 is a schematic perspective view of a part of an ink jet recording apparatus in accordance with the present invention.

This ink jet recording apparatus in accordance with the present invention employs two ink holders, one for an ink container which stores Y, M and C color inks, and the other for an ink container which stores black ink (K). Each holder 300 is removably mountable on a carriage 501 with assistance from an unillustrated mechanism. The carriage 501 is slidably engaged with a guide rail 504, and is connected to a part of a belt 502 which is stretched around a pair of pulleys and is rotatively driven by an unillustrated motor. With this arrangement, the carriage 501 is enabled to move along the guide rail 504. Below the carriage 501, a recording paper 506 as a recording medium is advanced at intervals of a predetermined distance by an unillustrated sheet advancing mechanism. Each time the recording paper 506 is advanced, the carriage 501 is moved along the guide rail 504, causing the ink jet head to scan the surface of the recording paper. As a result, images or the like are recorded on the recording paper 506.

At one end of the moving range of the carriage 501, an ejection performance recovery unit 600 is provided. The cap 601 of the ejection performance recovery unit 600 can cover the ink jet head surface at which the ink ejection outlets are open.

In the preceding embodiments, the liquid which is stored in an ink container was described as yellow, magenta, cyan, or the like color ink, but it is needless to say that liquid selection is not limited to those described above. For example, such liquid that coagulates dye molecules in ink may be included in the liquid selection.

As is evident from the above descriptions, according to the present invention, a groove is placed between the adjacent two ink delivery ports of an ink container which has a plurality of ink delivery ports, each of which delivers an ink of different color, wherein these grooves are parallel to the direction in which the ink container is mounted or dismounted. Therefore, even if one of the adjacent two ink delivery ports leaks, the groove between the two ports prevents the leaked ink from reaching the other.

As a result, even if ink leaks from the ink delivery port during the transportation of an ink container or in the like situation, occurrence of ink mixture is prevented, making it possible to always deliver recording of high quality.

As described above, according to the present invention, the positional arrangement of a plurality of ink delivery ports of an ink container is devised in consideration of the ink container movement during its insertion into an ink container holder, so that even if ink leaks from the ink delivery port during the mounting or dismounting of the ink container, occurrence of ink mixture is appropriately prevented to always deliver recording of high quality.

Further, when the ink container is mounted in the ink container holder, the ink container is first guided along the guide member provided on the inward surface of the holder, and then, after the leading end thereof reaches the end of the guide member, the ink container is rotated about the bottom front end thereof to be properly set in the holder. Therefore, even an ink container of a relatively larger size requires a relatively small space above the holder, and also, an ink container can be smoothly and reliably mounted in an ink container holder. Consequently, the need for applying excessive external force to mount an ink container is eliminated, effectively preventing ink from leaking from an ink delivery port during the mounting or dismounting of an ink container.

Further, a cap which is used when an ink container is transported or in the like situations is provided with a plurality of elastic sealing members, as well as a plurality of projections which are greater in height and length than the elastic sealing members, and are placed in parallel to the elastic members, wherein these projections are fitted in the grooves one for one to prevent the cap from coming off the ink container and soiling the hand of the user during the transportation of the ink container or in the like situation.

While the invention has been described with reference to the structures disclosed herein, it is not confined to the details set forth and this application is intended to cover such modifications or changes as may come within the purposes of the improvements or the scope of the following claims.

What is claimed is:

1. An ink container detachably mountable in an opening of an ink container holder, said ink container comprising:

a claw-like projection for engagement with a first hole provided in an inner surface of the opening adjacent one end of the opening;

a latch claw for engagement with a second hole provided in an inner surface of the opening, said latch claw being provided on a latch lever resiliently supported on said ink container;

a first recording liquid supply port, provided in a bottom side of said ink container, for supplying a first recording liquid to the outside; and a second recording liquid supply port provided in the bottom side of said ink container, for supplying a second recording liquid of a kind different from said first recording liquid to outside;

wherein a groove is provided in a direction from said claw-like projection toward said latch claw between said first recording liquid supply port of said ink container and said second recording liquid supply port.

2. An ink container according to claim 1, wherein a plurality of lines of ink supply ports for supplying similar color inks are provided in a section defined by two of said grooves.

3. An ink container according to claim 1, wherein said groove has a width which reduces toward a direction of mounting said ink container in said opening, and an ink retaining member for holding the ink in the ink container is compressed in accordance with the width of said groove.

4. An ink container detachably mountable in an opening of an ink container holder, said ink container comprising:

a claw-like projection for engagement with a first hole provided in an inner surface of the opening adjacent one end of the opening;

a latch claw for engagement with a second hole provided in an inner surface of the opening, said latch claw being provided on a latch lever resiliently supported on said ink container;

a first recording liquid supply port, provided in a bottom side of said ink container for supplying a first recording liquid to outside;

a second recording liquid supply port, provided in the bottom side of said ink container, for supplying a second recording liquid of a kind different from said first recording liquid to outside; and a third ink supply port, provided in the bottom side of said ink container, for supplying recording liquid having a density higher than that of said second recording liquid;

wherein grooves are provided in a direction from said claw-like projection toward said latch claw between said first ink supply port and said second ink supply port and between said first ink supply port and said third ink supply port, respectively; and wherein said third ink supply port is disposed closer to said claw-like projection than said second ink supply port.

5. An ink container holder for detachably mounting an ink container, said ink container holder comprising:

an ink ejection head portion;

an opening for receiving the ink container, said opening having first and second end walls;

a first hole for engagement with a claw-like projection provided on said ink container, said hole being formed at said first end wall of said opening;

a second hole for engagement with a latch claw provided on a latch lever resiliently supported on said ink container at said second end wall of said opening;

a first ink receiving pipe for connection with a first ink supply port of said ink container, said first ink receiving pipe being supplied with a first recording liquid from said ink container; and a second ink receiving pipe for connection with a second ink supply port of said ink container, said second ink receiving pipe being supplied with a second recording liquid from said ink container, said first and second recording liquids differing from each other;

wherein a groove is provided in a direction from said claw-like projection toward said latch claw between said first recording liquid supply port of said ink container and said second recording liquid supply port.

6. An ink container holder according to claim 5, further comprising an elastic member having a part with a section that is horn-like when taken along a connecting direction.

7. An ink container holder according to claim 5, further comprising a flow path formation member, at a bottom portion of the ink container holder, for forming an ink flow path between said ink election portion and at least one of said first and second ink receiving pipes.

8. An ink container holder according to claim 5, further comprising a flow path formation member, at a bottom portion of the ink container holder, for forming an ink flow between said ink election portion and at least one of said first and second ink receiving pipes, wherein a part of said flow path formation member is transparent.

9. An ink jet cartridge comprising:

an ink container holder provided with an ink ejection head portion; and an ink container detachably mountable in an opening of said ink container holder;

wherein said ink container comprises:

a claw-like projection for engagement with a first hole provided in an inner surface of the opening adjacent one end of the opening;

a latch claw for engagement with a second hole provided in an inner surface of the opening, said latch claw being provided on a latch lever resiliently supported on said ink container;

a first recording liquid supply port, provided in a bottom side of said ink container, for supplying a first recording liquid to the outside; and a second recording liquid supply port provided in the bottom side of said ink container, for supplying a second recording liquid of a kind different from said first recording liquid to outside;

wherein a groove is provided in a direction from said claw-like projection toward said latch claw between said first recording liquid supply port of said ink container and said second recording liquid supply port.

10. A cap detachably mountable to an ink container, wherein said ink container is detachably mountable in an opening of an ink container holder and includes a claw-like projection for engagement with a first hole provided in an inner surface of the opening adjacent one end of the opening, a latch claw for engagement with a second hole provided in an inner surface of he opening, said latch claw being provided on a latch lever resiliently supported on said ink container, said ink container further including a first ink supply port, provided in a bottom side of said ink container, for supplying a first recording liquid to outside, and a second ink supply port, provided in the bottom side of said ink container, for supplying a second recording liquid different from the first recording liquid, wherein a groove is provided in a direction from said claw-like projection toward said latch claw between said first recording liquid supply port of said ink container and said second recording liquid supply port, said cap comprising:

a plurality of elastic seal members for sealing a corresponding plurality of ink supply ports in said ink container; and a projection provided between said elastic seal members and having a height larger than that of said elastic seal members and a length larger than that of elastic seal members, wherein the projection enters a groove of said ink container to separate the ink supply ports.

* * * * *

UNITED STATES PATENT AND TRADEMARK OFFICE

CERTIFICATE OF CORRECTION

PATENT NO. : 6,102,533

DATED : August 15, 2000

INVENTOR(S) : Minoru Nozawa and Keiichiro Tsukuda

It is certified that error appears in the above-identified patent and that said Letters Patent is hereby corrected as shown below:

COLUMN 1

Line 23, change "there are" to --there is--.

COLUMN 2

Line 54, change "points" to --joints--;
Line 61, change "therefor" to --therefore--; and
Line 65, change "In crease" to --Increase--.

COLUMN 4

Line 42, change "Wink" to --ink--.

COLUMN 7

Line 37, change "304," to --307,--.

COLUMN 11

Line 31, change "curvatures" to -- --curvature--..

UNITED STATES PATENT AND TRADEMARK OFFICE

CERTIFICATE OF CORRECTION

PATENT NO. : 6,102,533

DATED : August 15, 2000

INVENTOR(S) : Minoru Nozawa and Keiichiro Tsukuda

It is certified that error appears in the above-identified patent and that said Letters Patent is hereby corrected as shown below:

COLUMN 16

Line 42, change "the-yellow" to --the yellow--.

COLUMN 17

Line 44, change "therefor" to --therefore--.

COLUMN 21

Line 1, change "he" to --the--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*